US009756926B2

(12) United States Patent
Byun

(10) Patent No.: US 9,756,926 B2
(45) Date of Patent: Sep. 12, 2017

(54) COSMETICS CONTAINER PROVIDED WITH INNER WALL SCRAPER

(71) Applicant: Young-chan Byun, Bucheon (KR)

(72) Inventor: Young-chan Byun, Bucheon (KR)

( * ) Notice: Subject to any disclaimer, the term of this patent is extended or adjusted under 35 U.S.C. 154(b) by 0 days.

(21) Appl. No.: 15/029,641

(22) PCT Filed: Oct. 6, 2014

(86) PCT No.: PCT/KR2014/009381

§ 371 (c)(1),
(2) Date: Apr. 15, 2016

(87) PCT Pub. No.: WO2015/115718

PCT Pub. Date: Aug. 6, 2015

(65) Prior Publication Data

US 2016/0345710 A1 Dec. 1, 2016

(30) Foreign Application Priority Data

Jan. 28, 2014 (KR) ..... 10-2014-0010359

(51) Int. Cl.

| | |
|---|---|
| ***A46B 11/00*** | (2006.01) |
| ***A45D 40/26*** | (2006.01) |
| *A45D 40/00* | (2006.01) |

(52) U.S. Cl.

CPC ..... *A45D 40/267* (2013.01); *A45D 40/265* (2013.01); *A45D 2040/0006* (2013.01); *A45D 2200/054* (2013.01); *A45D 2200/20* (2013.01); *A46B 2200/1046* (2013.01); *A46B 2200/1053* (2013.01)

(58) Field of Classification Search

CPC ..... A45D 40/265; A45D 40/267; A46B 2200/1046; A46B 2200/1053

USPC ..... 401/122, 126, 129; 132/218

See application file for complete search history.

(56) References Cited

U.S. PATENT DOCUMENTS

| | | | | |
|---|---|---|---|---|
| 4,984,918 A * | 1/1991 | Iizuka | B01F 13/002 | 401/122 |
| 5,172,992 A * | 12/1992 | Ackermann | A45D 34/048 | 401/129 |
| 5,192,153 A * | 3/1993 | Gueret | A45D 34/048 | 401/129 |
| 7,931,140 B2 * | 4/2011 | Heidenreiter | A45D 34/048 | 206/219 |

FOREIGN PATENT DOCUMENTS

| | | |
|---|---|---|
| JP | 06-000008 | 1/1994 |
| JP | 08-000564 | 4/1996 |
| JP | 2515926 | 8/1996 |
| JP | 2010-148658 | 7/2010 |
| KR | 20-1990-0009607 | 10/1990 |

* cited by examiner

*Primary Examiner* — Jennifer C Chiang
(74) *Attorney, Agent, or Firm* — Lex IP Meister, PLLC

(57) ABSTRACT

A cosmetic container allows all of the residual cosmetics remaining on the inner wall of the cosmetic container to be used by having the scraper within the container main body that receives the cosmetics.

6 Claims, 5 Drawing Sheets

COSMETICS CONTAINER PROVIDED WITH INNER WALL SCRAPER

TECHNICAL FIELD

The present invention generally relates to a cosmetic container having an inner wall scraper. More particularly, the present invention relates to a cosmetic container having an inner wall scraper, the cosmetic container configured such that a piped-shaped scraper is provided in a container main body that receives cosmetics therein so as to scrape and move downwardly residual cosmetics remaining on an inner wall of the container main body, or stir the residual cosmetics.

BACKGROUND ART

In general, a cosmetic container used for mascara or lip gloss has been developed to be small in size so as to be convenient to use and carry because a small amount of mascara or lip gloss is applied at a time.

As a document of related art, Korean Utility Model Registration No. 20-0394669 discloses a conventional cosmetic container, and FIG. 1 is a sectional view illustrating a configuration of the conventional cosmetic container.

Herein, as shown in FIG. 1, the conventional cosmetic container includes: a cylindrical container main body 2 for receiving cosmetics (mascara liquid or lip gloss liquid) 6; a cap 3 detachably provided at an upper portion of the container main body so as to seal the inside of the container main body 2; a rod 4 provided at a lower portion of the cap 3, with bristles 5 at an end thereof for taking up and applying the cosmetics 6; and a blade unit 7 at an upper portion of the container main body 2 for adjusting quantity of the cosmetics 6 on the bristles 5 when the bristles are taken out of the container.

The conventional cosmetic container configured as described above is used by taking the cosmetics 6 received in the container main body 2 out of the container using the bristles 5, and then the cosmetics 6 are applied on a part of a user's body.

However, the conventional cosmetic container is problematic in that it is difficult to use up all of the cosmetics 6 received in the container main body 2 because the container main body 2 is usually formed into a cylindrical shape, thereby causing the viscous cosmetics 6 to remain on the inner wall of the container main body 2.

The conventional cosmetic container is further problematic in that undesirable substances are easily mixed with the cosmetics 6 when recharging the cosmetics in the container because the residual cosmetics 6 remaining on the inner wall of the container main body 2 are solidified due to air contact as time goes by.

The conventional cosmetic container is further problematic in that it is impossible to prevent deterioration of the cosmetics 6 because the cosmetics 6, which are deposited at the bottom of the container as time goes by, are used as they are.

DISCLOSURE

Technical Problem

Accordingly, the present invention has been made keeping in mind the above problems occurring in the related art, and the present invention is intended to propose a cosmetic container having an inner wall scraper, the cosmetic container being capable of: scraping and moving residual cosmetics remaining on an inner wall of a container main body receiving cosmetics therein downwardly by providing a scraper within the container main body; easily moving the residual cosmetics on the inner wall of the container main body downwardly by providing a concave slope at an edge of the scraper; stirring the cosmetics and allowing the cosmetics on the inner wall of the container main body to move downwardly with ease by providing a helical ridge on an inner circumferential surface of the scraper; improving both rotary motion and a degree of sealing by providing both a retainer and sealing ring on an outer circumferential surface of the scraper; and allowing a user to easily rotate the scraper by providing a rotating cylinder that is connected to a lower portion of the scraper.

Technical Solution

In order to achieve the above object, according to one aspect of the present invention, there is provided a cosmetic container having an inner wall scraper, the cosmetic container being carried with to use cosmetics, the cosmetic container including: a cylindrical container main body having an open top so as to receive cosmetics, and a hole in a bottom wall thereof; a cap coupled to an upper portion of the container main body and provided with bristles at a lower portion thereof for taking cosmetics out of the container main body; and a scraper unit seated on an inner wall of the container main body, the scraper unit including: a rotation rod provided at a lower portion thereof and penetrating through the hole; and a pipe-shaped scraper provided at an upper portion thereof and being cut on a sidewall so as to come into contact with the inner wall of the container main body.

The scraper may be provided with a concave slope at a fore edge of the cut portion thereof in view of rotation to be concave in a direction opposite to a rotating direction of the scraper such that the residual cosmetics remaining on an inner wall of the container main body are moved downwardly, wherein a cross section of the concave slope is formed with a sloping surface such that the sloping surface scrapes and moves the residual cosmetics on the inner wall of the container main body into the scraper.

The scraper may be provided with a helical ridge on an inner circumferential surface thereof by protruding so as to downwardly move the cosmetics scraped from the inner wall of the container main body.

The scraper may be provided with a retainer seat at a lowermost end thereof by being formed in an inwardly stepwise, with an annular retainer fitted over the retainer seat and coming into close contact with the inner wall of the container main body.

The scraper may be provided with an annular groove at a lower portion of an outer circumferential surface thereof by being concavely formed, with an elastic sealing ring seated in the annular groove.

The container main body may be provided with a rotating cylinder at a location below the bottom wall thereof, the rotating cylinder connected to the rotation rod so as to allow the scraper unit to rotate; and a rod connection hole may be formed in an upper portion of the rotating cylinder for receiving the rotation rod.

The rotation rod may be provided with an externally toothed part at a lower portion of an outer circumferential surface thereof such that the scraper unit is rotated when the rotating cylinder is rotated; and the rod connection hole may be provided with an internally toothed part at a lower portion of an inner circumferential surface thereof such that the externally toothed part is engaged with the internally toothed part.

The rotation rod may be provided with a stop protrusion on an outer circumferential surface thereof for preventing the rotating cylinder from falling off when coupled with the rotation rod; and the rod connection hole may be provided with a stop groove on an inner circumferential surface thereof for allowing the stop protrusion to be engaged therewith.

Advantageous Effects

According to the present invention having the above-described characteristics, a cosmetic container having an inner wall scraper has the following advantageous effects.

Firstly, the cosmetic container is configured such that a pipe-shaped scraper being cut on a sidewall thereof is provided in a container main body that receives cosmetics, thereby being capable of allowing all of the cosmetics to be used and thus reducing waste thereof, by scraping and moving downwardly the residual cosmetics remaining on the inner wall of the container.

Secondly, the cosmetic container may be configured such that the scraper is provided with a concave slope at a fore edge of a cut portion thereof in view of rotation to be concave in a direction opposite to a rotating direction of the scraper, thereby being capable of inducing the residual cosmetics remaining on the inner wall of the container main body to move downwardly when the scraper unit is rotated, wherein a cross section of the concave slope is formed with a sloping surface, whereby the sloping surface can easily scrape the residual cosmetics on the inner wall of the container main body.

Thirdly, the scraper may be provided with a protruding helical ridge on an inner circumferential surface thereof, thereby being capable of moving the cosmetics scraped from the inner wall of the container main body, and further allowing the cosmetics deposited in the container for a long time to feel fresh to the user by simply rotating the scraper.

Fourthly, the scraper may be configured such that: an annular retainer is provided on an outer circumferential surface of the scraper, thereby facilitating rotary motion of the scraper by retaining a location thereof; and an elastic sealing ring is provided on the outer circumferential surface of the scraper above the annular retainer, thereby being capable of preventing leakage of the cosmetics in the container main body through a hole.

Fifthly, a rotating cylinder connected to a lower portion of the scraper may be provided with an internally toothed part on an inner circumferential surface thereof, and the scraper may be provided with an externally toothed part at the lower portion thereof for being engaged with the internally toothed part, thereby allowing the scraper to be easily rotated when the rotating cylinder is rotated.

Lastly, the scraper may be provided with a stop protrusion at a lower portion thereof, and the rotating cylinder may be provided with a stop groove on the inner circumferential surface thereof, thereby being capable of preventing the rotating cylinder from falling off when coupled with the scraper by the stop protrusion being engaged with the stop groove, and thus improving a degree of coupling therebetween.

BEST MODE

Reference will now be made in greater detail to an exemplary embodiment of the present invention, an example of which is illustrated in the accompanying drawings.

Figure 1:
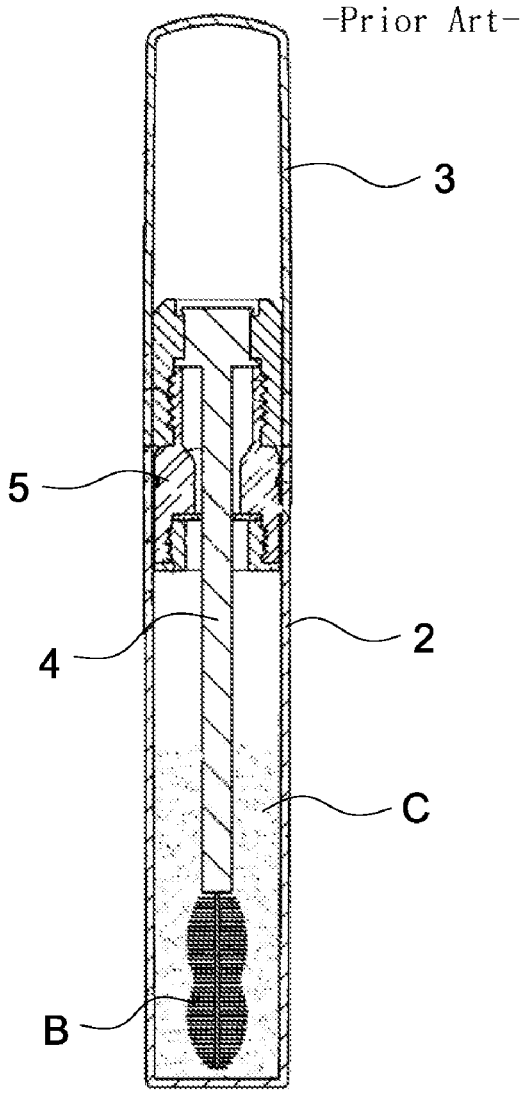
FIG. 1 is a sectional view illustrating a structure of a conventional cosmetic container.
Figure 2:
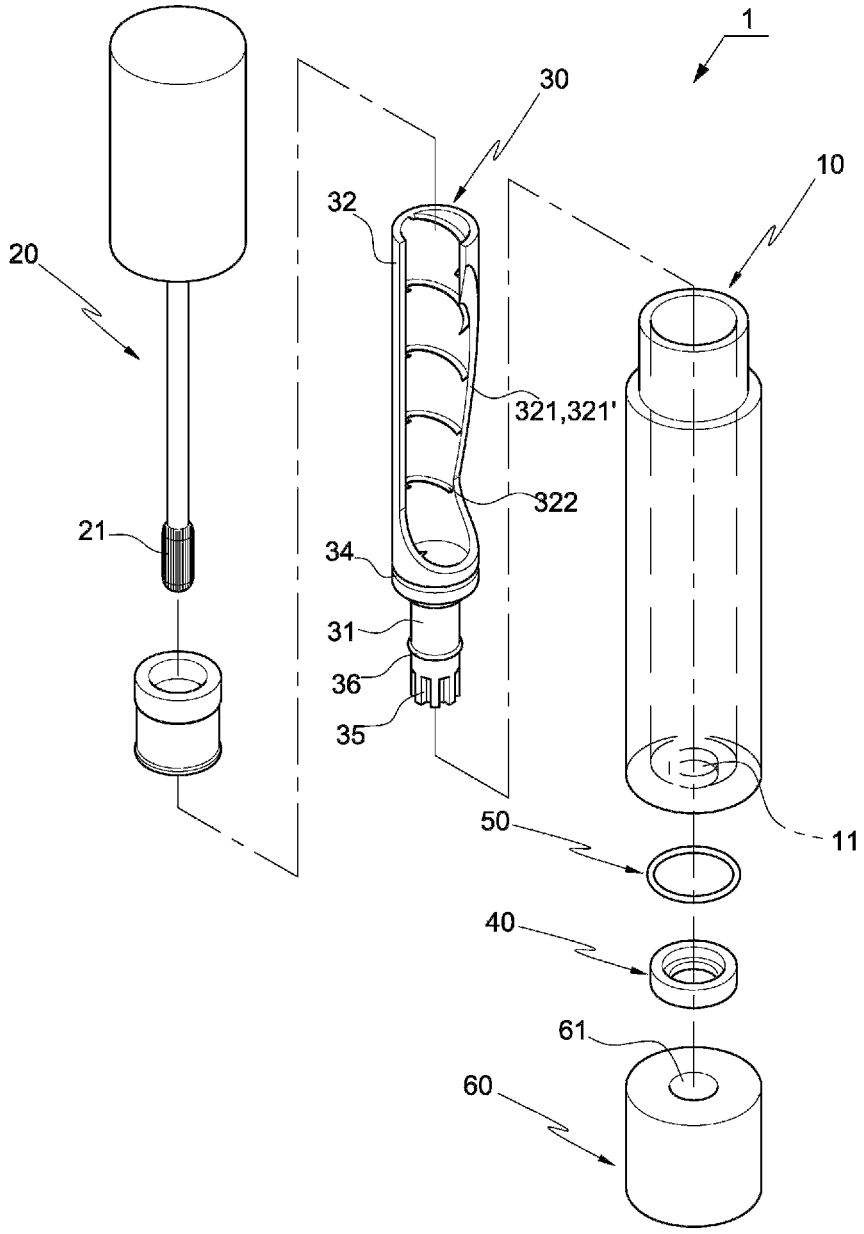
FIG. 2 is an exploded perspective view illustrating a configuration of a cosmetic container according to an embodiment of the present invention.
Figure 3:
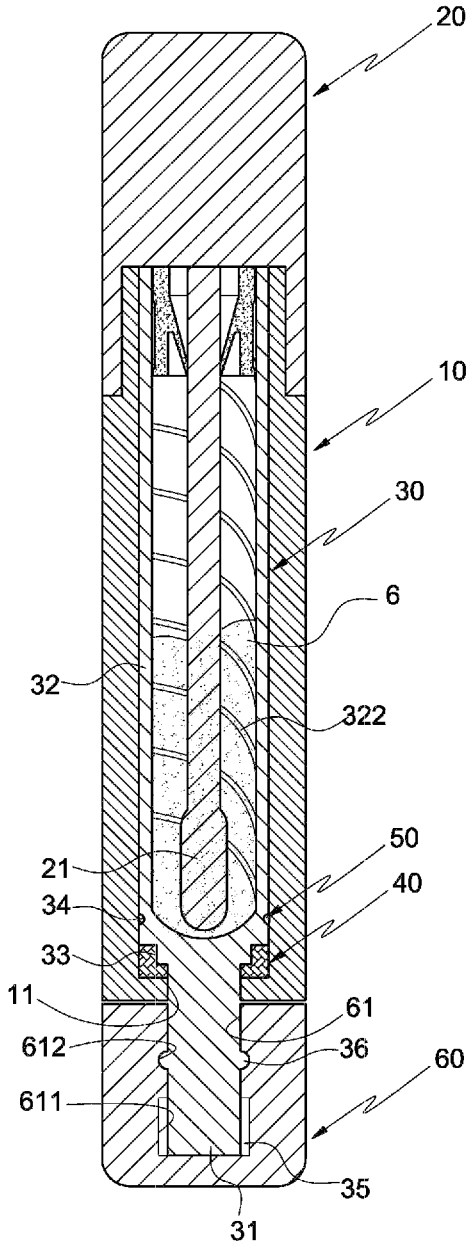
FIG. 3 is a sectional view illustrating a structure of the cosmetic container according to the embodiment of the present invention.

As shown in FIGS. 2 to 3, a cosmetic container 1 having an inner wall scraper according to the present invention, the cosmetic container being carried with to use cosmetics 6, includes: a cylindrical container main body 10 having an open top so as to receive the cosmetics 6, and a hole 11 in a bottom wall thereof; a cap 20 coupled to an upper portion of the container main body 10 and provided with bristles 21 at a lower portion thereof for taking the cosmetics 6 out of the container main body; and a scraper unit 30 seated on an inner wall of the container main body 10, the scraper unit including: a rotation rod 31 provided at a lower portion thereof and penetrating through the hole 11; and a pipe-shaped scraper 32 provided at an upper portion thereof and being cut on a sidewall so as to come into contact with the inner wall of the container main body 10.

Meanwhile, it is preferred that the cap 20 is formed with internal threads (not shown) on an inner circumferential surface thereof so as to seal the upper portion of the container main body 10, and the container main body 10 is formed with external threads (not shown) on an outer circumferential surface at the upper portion thereof so as to be engaged with the cap.

Herein, it is preferred that the container main body 10 is provided with an adjuster at the upper portion thereof for adjusting quantity of the cosmetics 6 by contacting the bristles with the outer circumferential surface of the container main body when the bristles 21 of the cap 20 are taken out of the container.

Figure 4:
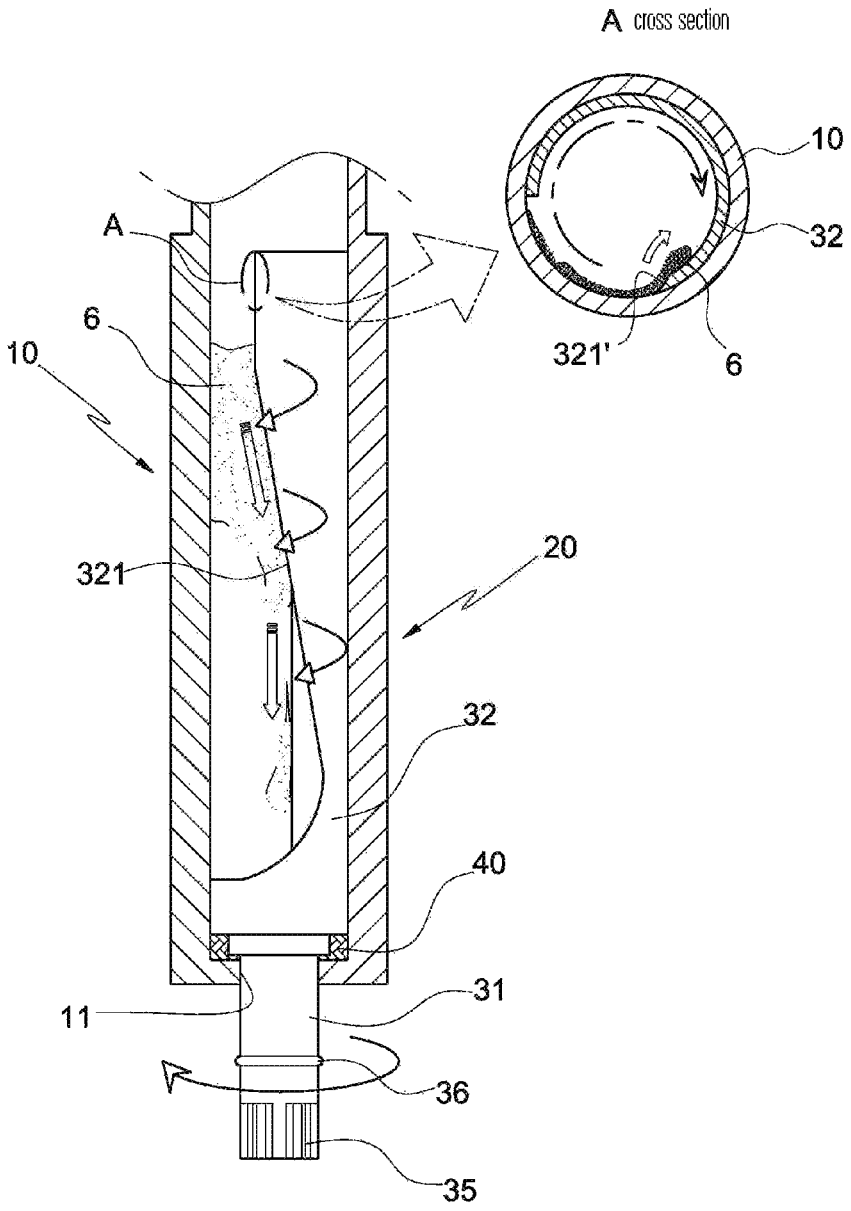
FIG. 4 is an operational view illustrating a state where a scraper unit according to the embodiment of the present invention is used.

Further, as shown in FIG. 4, the scraper 32 may be provided with a concave slope 321 at a fore edge of the cut portion thereof in view of rotation to be concave in a direction opposite to a rotating direction of the scraper such that the residual cosmetics 6 remaining on the inner wall of the container main body 10 are moved downwardly.

Here, as shown in an enlarged view of FIG. 4, a cross section of the concave slope 321 is formed with a sloping surface 321' such that the sloping surface scrapes and moves the residual cosmetics 6 on the inner wall of the container main body 10 into the scraper 32.

Further, the scraper 32 may be provided with a helical ridge 322 on an inner circumferential surface thereof by protruding so as to move downwardly the cosmetics 6 scraped from the inner wall of the container main body 10.

Figure 5:
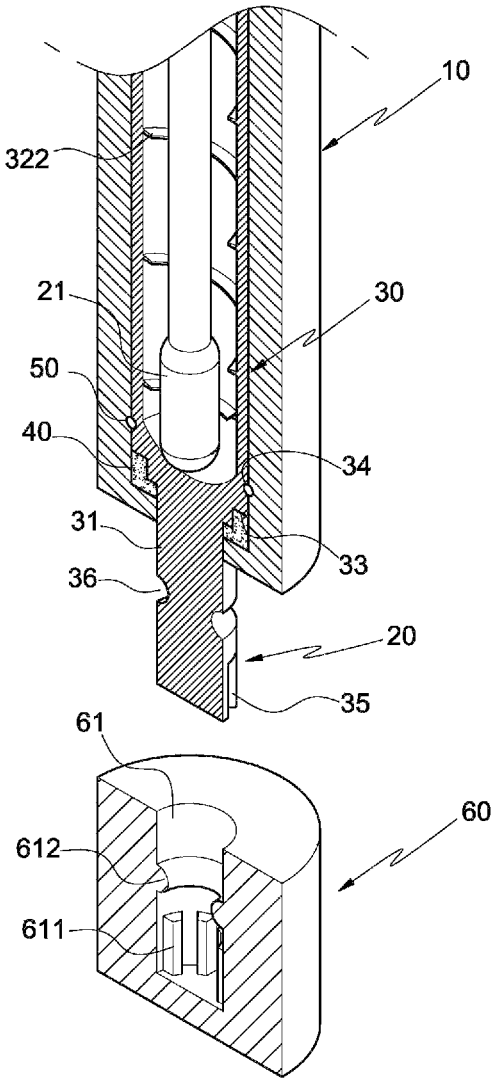
FIG. 5 is a partial exploded perspective view illustrating a rotating cylinder according to another embodiment of the present invention.

Further, as shown in FIG. 5, the scraper 32 may be provided with a retainer seat 33 at a lowermost end thereof by being formed in an inwardly stepwise, with an annular retainer fitted over the retainer seat 33 and coming into close contact with the inner wall of the container main body 10.

Further, the scraper 32 may be provided with an annular groove 34 at a lower portion of an outer circumferential surface thereof by being concavely formed, with an elastic sealing ring 50 seated in the annular groove 34.

Meanwhile, the container main body 10 may be provided with a rotating cylinder 60 at a location below the bottom wall thereof, the rotating cylinder connected to the rotation rod 31 so as to allow the scraper unit 30 to rotate; and a rod connection hole 61 may be formed in an upper portion of the rotating cylinder 60 for receiving the rotation rod 31.

Further, the rotation rod 31 may be provided with an externally toothed part 35 at a lower portion of an outer circumferential surface thereof such that the scraper unit 30 is rotated when the rotating cylinder 60 is rotated; and the rod connection hole 61 may be provided with an internally toothed part 611 at a lower portion of an inner circumferential surface thereof such that the externally toothed part 35 is engaged with the internally toothed part 611.

Further, the rotation rod 31 may be provided with a stop protrusion 36 on the outer circumferential surface thereof for preventing the rotating cylinder 60 from falling off when coupled with the rotation rod; and the rod connection hole 61 may be provided with a stop groove 612 on an inner circumferential surface thereof for allowing the stop protrusion 36 to be engaged therewith.

Reference will now be made to operation of the cosmetic container having an inner wall scraper configured as described above.

The cosmetic container having an inner wall scraper according to the present invention is configured such that the pipe-shaped scraper 32 being cut on the sidewall is penetratingly coupled to a lower portion of the cylindrical container main body 10 that receives the cosmetics 6, and comes into contact with the inner wall of the container main body 10 so as to scrape the residual cosmetics 6 remaining on the inner wall of the container main body, whereby it is possible to use up all of the residual cosmetics in the cosmetic container.

Here, as shown in FIG. 4, the scraper 32 may be provided with the concave slope 321 at the fore edge of the cut portion thereof in view of rotation to be concave in a direction opposite to the rotating direction of the scraper, thereby being capable of inducing the residual cosmetics 6 remaining on the inner wall of the container main body 10 to move downwardly when the scraper unit 30 is rotated.

Herein, the cross section of the concave slope 321 is formed with the sloping surface 321', whereby the sloping surface can easily scrape the residual cosmetics 6 on the inner wall of the container main body 10.

Further, the scraper 32 may be provided with the helical ridge 322 on the inner circumferential surface thereof by protruding so as to downwardly move the cosmetics 6 scraped from the inner wall of the container main body 10, whereby it is possible to induce the cosmetics 6 moving along the sloping surface 321' to move downwardly and it is possible to stir the cosmetics 6.

Further, as shown in FIG. 5, the scraper 32 may be provided with the retainer seat 33 at the lowermost end thereof by being formed in an inwardly stepwise, with the annular retainer 40 fitted over the retainer seat 33, whereby it is possible to facilitate rotary motion of the scraper by retaining a location thereof.

Herein, the scraper 32 may be provided with the elastic sealing ring 50 at the lower portion of the outer circumferential surface thereof, thereby being capable of preventing leakage of the cosmetics 6 in the container main body 10 through the hole 11.

Further, the container main body 10 may be provided with the rotating cylinder 60 at the location below the bottom wall thereof, with the rod connection hole 61 formed in the upper portion of the rotating cylinder 60 for receiving the rotation rod 31, thereby being capable of allowing a user to rotate the scraper unit 30 with ease.

Here, the rotation rod 31 may be provided with the externally toothed part 35 at the lower portion of the outer circumferential surface thereof, and the rod connection hole 61 may be provided with the internally toothed part 611 at the lower portion of the inner circumferential surface thereof, thereby being capable of allowing the scraper unit 30 to be easily rotated when the rotating cylinder 60 is rotated.

Meanwhile, the rotation rod 31 may be provided with the stop protrusion 36 on the outer circumferential surface thereof, and the rod connection hole 61 may be provided with the stop groove 612 on the inner circumferential surface thereof, thereby being capable of preventing the rotating cylinder 60 from falling off when coupled with the rotation rod by the stop protrusion 36 being engaged with the stop groove 612.

Although a preferred embodiment of the present invention has been described for illustrative purposes, those skilled in the art will appreciate that various modifications, additions and substitutions are possible, without departing from the scope and spirit of the invention as disclosed in the accompanying claims.

[Description of reference characters of important parts]

| | |
|---|---|
| 1: cosmetic container | 10: container main body |
| 11: hole | 20: cap |
| 21: bristles | 30: scraper unit |
| 31: rotation rod | 32: scraper |
| 321: concave slope | 321': sloping surface |
| 322: helical ridge | 33: retainer seat |
| 34: annular groove | 35: externally toothed part |
| 36: stop protrusion | 40: retainer |
| 50: sealing ring | 60: rotating cylinder |
| 61: rod connection hole | 611: internally toothed part |
| 612: stop groove | 6: cosmetics |

The invention claimed is:

1. A cosmetic container (1) having an inner wall scraper, the cosmetic container being carried with to use cosmetics (6), the cosmetic container comprising:

a cylindrical container main body (10) having an open top so as to receive the cosmetics (6), and a hole (11) in a bottom wall thereof;

a cap (20) coupled to an upper portion of the container main body (10) and provided with bristles (21) at a lower portion thereof for taking the cosmetics (6) out of the container main body; and a scraper unit (30) seated on an inner wall of the container main body (10), the scraper unit including: a rotation rod (31) provided at a lower portion thereof and penetrating through the hole (11); and a pipe-shaped scraper (32) provided at an upper portion thereof and being cut on a sidewall so as to come into contact with the inner wall of the container main body (10), wherein the container main body (10) is provided with a rotating cylinder (60) at a location below the bottom wall thereof, the rotating cylinder connected to the rotation rod (31) so as to allow the scraper unit (30) to rotate;

a rod connection hole (61) is formed in an upper portion of the rotating cylinder (60) for receiving the rotation rod (31);

the rotation rod (31) is provided with a stop protrusion (36) on an outer circumferential surface thereof for preventing the rotating cylinder (60) from falling off when coupled with the rotation rod; and the rod connection hole (61) is provided with a stop groove (612) on an inner circumferential surface thereof for allowing the stop protrusion (36) to be engaged therewith.

2. The cosmetic container of claim 1, wherein the scraper (32) is provided with a concave slope (321) at a fore edge of the cut portion thereof in view of rotation to be concave in a direction opposite to a rotating direction of the scraper such that the residual cosmetics (6) remaining on the inner wall of the container main body (10) are moved downwardly, wherein a cross section of the concave slope (321) is formed with a sloping surface (321') such that the sloping surface scrapes and moves the residual cosmetics (6) on the inner wall of the container main body (10) into the scraper (32).

3. The cosmetic container of claim 1, wherein the scraper (32) is provided with a helical ridge (322) on an inner circumferential surface thereof by protruding so as to downwardly move the cosmetics (6) scraped from the inner wall of the container main body (10).

4. The cosmetic container of claim 1, wherein the scraper (32) is provided with a retainer seat (33) at a lowermost end thereof by being formed in an inwardly stepwise, with an annular retainer (40) fitted over the retainer seat (33) and coming into close contact with the inner wall of the container main body (10).

5. The cosmetic container of claim 1, wherein the scraper (32) is provided with an annular groove (34) at a lower portion of an outer circumferential surface thereof by being concavely formed, with an elastic sealing ring (50) seated in the annular groove (34).

6. The cosmetic container of claim 1, wherein the rotation rod (31) is provided with an externally toothed part (35) at a lower portion of an outer circumferential surface thereof such that the scraper unit (30) is rotated when the rotating cylinder (60) is rotated; and the rod connection hole (61) is provided with an internally toothed part (611) at a lower portion of an inner circumferential surface thereof such that the externally toothed part (35) is engaged with the internally toothed part (611).

* * * * *